US006626725B1

(12) United States Patent
Bell

(10) Patent No.: US 6,626,725 B1
(45) Date of Patent: Sep. 30, 2003

(54) ELECTRODE TREATMENT SURFACE PROCESS FOR REDUCTION OF A SEAL CRACKS IN QUARTZ

(75) Inventor: Dean A. Bell, Marcellus, NY (US)

(73) Assignee: Welch Allyn, Inc, Skaneateles Falls, NY (US)

( * ) Notice: Subject to any disclaimer, the term of this patent is extended or adjusted under 35 U.S.C. 154(b) by 0 days.

(21) Appl. No.: 09/566,424

(22) Filed: May 8, 2000

(51) Int. Cl.[7] ..... H01J 9/04
(52) U.S. Cl. ..... 445/35; 313/633; 445/50
(58) Field of Search ..... 445/35, 50, 51, 445/26, 43, 58, 57; 313/491, 493, 574, 624, 623, 626, 633, 578

(56) References Cited

U.S. PATENT DOCUMENTS 3,231,332 A * 1/1966 Jones et al. ..... 313/357
3,448,320 A 6/1969 Millikan
5,905,340 A * 5/1999 Karlotski et al. ..... 313/633

FOREIGN PATENT DOCUMENTS

| | | |
|---|---|---|
| EP | 0 330 268 A1 | 8/1989 |
| EP | 0 343 625 A2 | 11/1989 |
| EP | 0 903 771 A2 | 3/1999 |
| EP | 1 065 698 A1 | 1/2001 |

* cited by examiner

*Primary Examiner*—Kenneth J. Ramsey
*Assistant Examiner*—Joseph Williams
(74) *Attorney, Agent, or Firm*—Wall Marjama & Bilinski LLP

(57) ABSTRACT

The invention relates to a tungsten electrode which causes minimal cracking when sealed in a quartz glass envelope. The invention includes forming a substantially uniform oxide coating on a selected portion of the shank of a tungsten electrode followed by reducing the oxide coating to substantially elemental tungsten, wherein the electrode exhibits superior properties when sealed in a lamp having a quartz glass envelope. The invention also includes the electrode made by the process.

6 Claims, 2 Drawing Sheets

ELECTRODE TREATMENT SURFACE PROCESS FOR REDUCTION OF A SEAL CRACKS IN QUARTZ

FIELD OF THE INVENTION

This invention relates generally to electrodes for discharge lamps, and more specifically to an improved electrode which exhibits a tighter seal, improved electrode alignment and improved seal integrity through the reduction of cracks when sealed in a quartz envelope.

BACKGROUND OF THE INVENTION

The present invention is directed to an improved electrode for a discharge lamp which exhibits superior stability and minimum cracking when sealed in the neck of a quartz glass envelope.

Sealing the shank portion of tungsten electrode in the neck of a quartz glass envelope results in stresses caused by differences in thermal expansion and contraction of the materials in contact, the quartz glass and the tungsten metal. There has always been a problem in the field with respect to cracking occurring in the envelope when the shank of the electrode is sealed in the neck portion.

With regard to addressing problems such as envelope cracking at the contact area with the shank portion of the electrode, the prior art appears to have taken a mechanical approach to addressing and solving the problem.

In U.S. Pat. No. 2,518,944 a foil is wrapped around the shank portion of an electrode to prevent the quartz from adhering to the electrode rod and enhance stability of the structure.

In U.S. Pat. No. 3,706,900, a metal helix is used to surround two straight ends of a filament body or electrode which is said to provide resistance to vibration and shocks.

U.S. Pat. No. 4,968,916 is directed to an improved lamp structure having an improved electrode structure. In this structure, coil filaments are situated in opposite neck portions of an envelope forming a light source so as to cause the electrodes to be axially aligned within the light source and keep the shank of the electrode from intimate contact with the envelope, thereby preventing the condensation of mercury and allowing for substantial vaporization of the metal halide ingredient at the neck portion. In addition, the coils function to prevent thermal expansion of the electrode from cracking the envelope.

It can be seen from the above teachings of the prior art, that a separate mechanical component such as a metal wrap or coil has long been used to enhance stability and/or reduce cracking in the neck portion of quartz glass envelopes.

There has, therefore, always been a need in the art for a method of accomplishing the above objectives without resorting to the use of an additional component within the lamp structure.

It is therefore an objective of the present invention to provide an electrode which exhibits superior stability and eliminates the cracking problems associated with sealing the electrode shank into the quartz envelope of a quartz discharge lamp.

It is a further object of the present invention to provide an electrode which exhibits minimal cracking when sealed within the neck of a quartz discharge lamp and which does not require the use of any added component to the lamp structure.

It is yet another object of the present invention to provide a specially treated electrode having resistance to cracking when sealed in a quartz glass envelope.

It is yet a further object of the present invention to provide a superior electrode which exhibits a specially treated shank portion which exhibits a tighter seal in a quartz glass envelope.

It is a further object of the present invention to provide a method for making an electrode which exhibits superior stability and minimal cracking when sealed in a quartz glass envelope.

It is yet another object of the present invention for making a tungsten electrode having a specially treated shank portion which exhibits a tighter seal and improved electrode alignment when sealed in a quartz glass envelope.

SUMMARY OF THE INVENTION

The present invention relates to a tungsten electrode which has a specially treated shank portion which exhibits a tighter seal and improved electrode alignment when sealed in a quartz glass envelope and reduces stress cracking within the seal neck of the envelope. More specifically, the electrode of the present invention contains a shank portion which has been specially treated to form a thin outer layer of elemental tungsten at the base portion of the shank which results in improved properties when sealed in a quartz glass envelope. The invention is also directed to a method of making a tungsten electrode suitable for use in a quartz discharge lamp which includes providing a tungsten electrode of a predetermined configuration having a tip portion and a shank portion. A substantially uniform oxide coating of tungsten is formed on a selected portion of the shank of the electrode. The oxide coating is then treated to reduce the oxide to substantially elemental tungsten which is in the form of a coherent thin layer loosely bonded over the selected shank portion. This thin outer elemental tungsten layer exhibits superior properties when sealed in a quartz envelope which results in a dramatic reduction in cracking in the neck portion of the envelope in the area adjacent the seal of the shank with the quartz glass in the neck portion. Further, this thin outer elemental tungsten layer allows for a substantially tighter seal with a significant reduction in the cracking in the neck portion of the envelope in the area adjacent the seal of the shank with the quartz glass in the neck portion.

In one embodiment, a tungsten oxide layer is formed on a predetermined, defined area of an electrode shank by exposing the area to an oxidizing atmosphere at a suitable elevated temperature for a time sufficient to build the oxide layer. The oxide layer is subsequently converted to an elemental tungsten layer by firing in a wet hydrogen furnace at a temperature of at least about 1200° C. which results in the formation of a loosely bonded tungsten surface layer.

It is well known that the onset of rapid oxidation of tungsten will occur at temperatures above 500° C. Oxides of tungsten in the form $WO_3$, tungsten trioxide, yellow-green in color, and $W_2O_5$, tungsten hemipentoxide, blue in color, are formed in this process. In the process of the present invention the heating of the tungsten is considerably higher, typically at or about 1200° C. At this temperature the initial onset of oxidation is rapid and the rate of reaction slows as the oxide layer thickness increases. In fact the rate of oxide formation appears to be inversely proportional to the oxide layer thickness. Therefore, time as well as temperature are two important factors in the development and control of the process. It is further known that tungsten must be heated above 700° C. in a hydrogen reducing atmosphere for any practical reduction of tungsten oxides. In fact at temperatures below about 700° C. tungsten oxides will persist and are characterized by visible color as is illustrated in Table 1.

TABLE 1

| Temperature ° C. in Hydrogen Atmosphere | Color | Surface |
|---|---|---|
| 600 | chocolate-brown | $WO_2$ |
| 650 | brown-black | $WO_2$ + W |
| 700 | gray-black | W |
| 800 | gray | W |
| 900 | metallic gray | W |
| 1000 | coarse metallic | W |

BRIEF DESCRIPTION OF THE DRAWING

For a more complete understanding of the nature and objects of the invention, reference should be made to the following detailed description of a preferred mode of practicing the invention, read in connection with the accompanying drawings, in which.

DETAILED DESCRIPTION OF THE INVENTION

Figures 1, 1A:
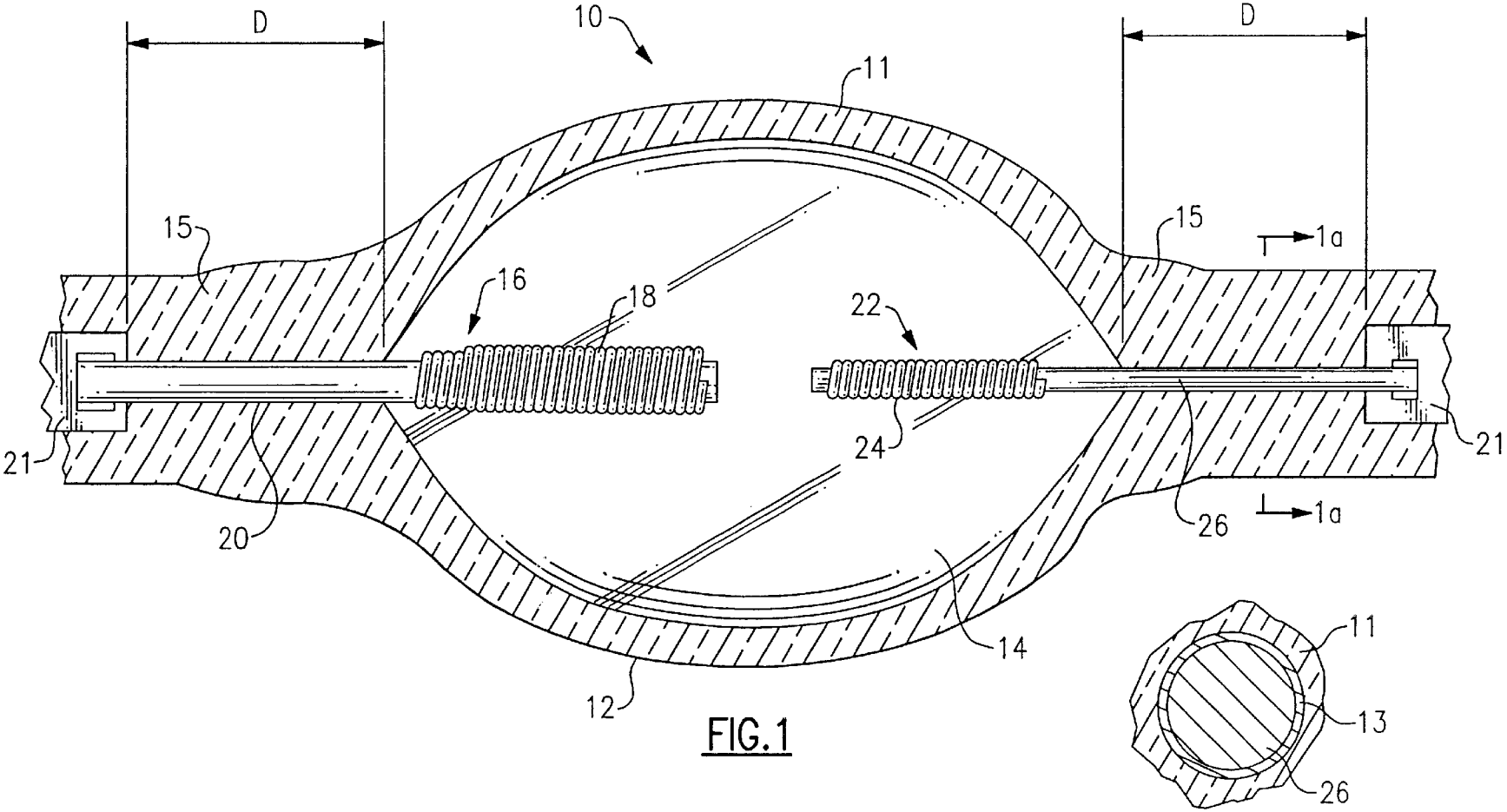
FIG. 1 is a side sectional view of a lamp envelope which exhibits the electrodes of the present invention.
FIG. 1*a* is a sectional view taken along line 1*a*—1*a* of FIG. 1 through the treated shank portion of the electrode.

FIG. 1 of the drawing illustrates a quartz glass envelope 10 of the present invention which is made of a quartz glass 11 having a chamber 14, a neck portion 15 and a pair of electrodes 16 and 22 having tip portions 18 and 24 and shank portions 20 and 26, respectively. Typically the end of each shank is connected to a metal foil 21, usually made of molybdenum. A substantially uniform oxide coating is formed on a selected portion D of the shank of each electrode. The oxide coating is then heat treated in a reducing atmosphere to reduce the oxide to substantially elemental tungsten which is in the form of a loosely bonded coherent thin layer 13 as illustrated in FIG. 1*a*.

Figure 3:
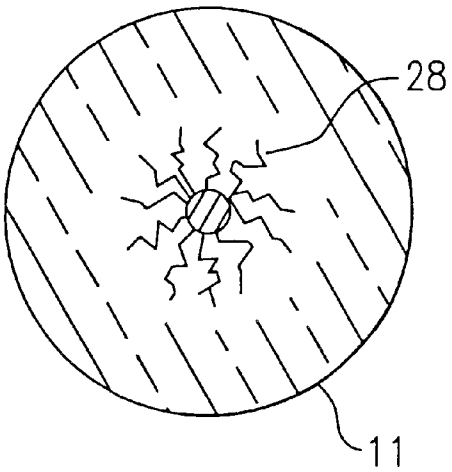
FIG.3 Prior Art
FIG. 3 is a sectional view of the shank area along line 3—3 of FIG. 2.
Figure 2:
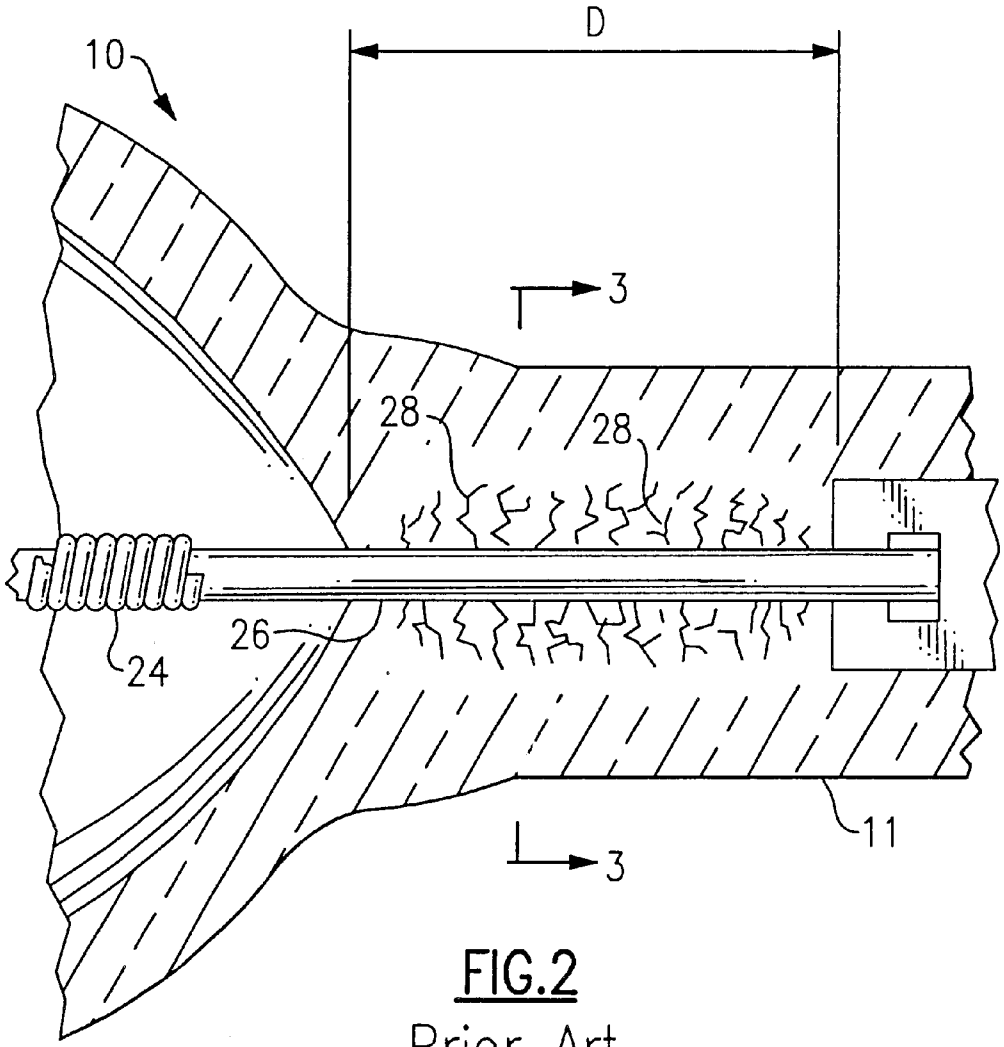
FIG.2 Prior Art
FIG. 2 is a partial side sectional view of a prior art lamp which exhibits characteristic cracking of the quartz glass in the electrode shank area.

FIGS. 2 and 3 illustrate, respectively, the same quartz envelope 10 of the prior art in which the shank 26 along predetermined length D exhibits characteristic cracks 28 in the seal area of the shank which are a persistent problem in the prior art.

The following example illustrates one embodiment of making an electrode of the present invention. The objective of the process is to produce a substantially uniform tungsten oxide layer which is subsequently reduced to yield a loosely bonded tungsten layer on a defined area of the anode or cathode shank for the purpose of improving quartz to anode or cathode seal integrity through the reduction of cracks in the quartz.

EXAMPLE

1. The electrode tip, that which is to be in the interior chamber of the finished arc lamp, is clamped in a suitable fixture to mechanically clamp or hold and heat sink said tip. The remainder of the electrode, the shank, is that which will be oxidized.

2. The unclamped portion of the shank is heated to incandescence in an oxygen containing atmosphere through the use of a flame from a oxygen-hydrogen torch. The color of the desired incandescence is between a dull red and a red orange. This is an approximate color temperature of 1000° K to 1400° K.

3. Once the desired incandescent temperature is achieved the shank is held at this temperature for sufficient time to build up a layer of tungsten oxide. Although dependent upon the diameter of the electrode shank, the time over which this oxide layer is established is generally less than one minute for electrodes less than 0.040" in diameter.

4. The tungsten electrode is removed from the fixture and the formed oxide layer is examined for proper formation and color. The oxide should be white-gray to slightly yellow in the center region, transitioning to a dark blue on the outer edges of the oxidized region. Further, the oxidized region should be uniformly covered with the oxide layer and should be free of gaps or voids.

5. The oxidized electrode is then fired in a hydrogen furnace (hydrogen gas bubbled through water) at 1200° C. for 15 minutes to reduce the tungsten oxide to essentially elemental tungsten. The reduced tungsten surface should appear as a fine grained, dark gray, uniform matte, finish without gaps or voids in the treated area. Note this appearance is consistent with the higher temperatures illustrated in Table 1.

6. The thickness of the resultant coherent thin elemental tungsten layer, loosely bonded to the tungsten substrate, may be verified by bending the electrode 90° at the midpoint of the treated region and observing the flaking off of the layer. Since this is a destructive test it only done on a sample basis for process control. A typical thickness for the elemental tungsten layer is about 0.0005 inches.

This process may alternately be accomplished by heating with an electrical current passed thru the tungsten electrode shank region to be treated. In a further embodiment, the process may be accomplished through heating accomplished by passing the region to be treated into close proximity of a resistive heating element.

While the present invention has been particularly shown and described with reference to the preferred mode as illustrated in the drawing, it will be understood by one skilled in the art that various changes in detail may be effected therein without departing from the spirit and scope of the invention as defined by the claims.

I claim:

1. A method for making a tungsten electrode suitable for use in a lamp which contains a quartz envelope which comprises:

(a) providing a tungsten electrode of a predetermined configuration having a tip portion and a shank portion;

(b) forming a substantially uniform oxide coating on a selected portion said shank;

(c) reducing said oxide coating to a loosely adhering coating of substantially elemental tungsten, whereby said electrode exhibits superior sealing properties when said tungsten coated portion of the shank is sealed in the neck of a lamp having a quartz glass envelope.

2. The method of claim 1 in which the reduction of said oxide coating to tungsten is carried out at an elevated temperature in a hydrogen atmosphere.

3. The electrode made by the process of claim 1.

4. A method for making a tungsten electrode suitable for use in a quartz lamp which comprises:

(a) providing a tungsten electrode of a predetermined configuration having a tip portion and a shank portion;

(b) forming a substantially uniform oxide coating on a selected portion of said shank;

(c) reducing said oxide coating to substantially elemental tungsten, whereby said electrode exhibits reduced cracking and superior sealing properties when the tungsten coated portion of the shank is sealed in the neck of a lamp having a quartz glass envelope.

5. The method of claim 4 in which said uniform oxide coating is formed by heating said selected portion of the shank to incandescence in an oxidizing atmosphere.

6. The electrode made by the process of claim 4.

* * * * *